US007614592B2

(12) United States Patent
Bean et al.

(10) Patent No.: US 7,614,592 B2
(45) Date of Patent: Nov. 10, 2009

(54) DEVICE AND METHOD FOR SECURING A BOW

(76) Inventors: Ron M. Bean, 3021 Southland St. SW., Cedar Rapids, IA (US) 52404; Howard L. Bean, Cedar Rapids, IA (US); Pearl K. Bean, legal representative, 378 27th ave. SW., Apt. 104, Cedar Rapids, IA (US) 52404

( * ) Notice: Subject to any disclaimer, the term of this patent is extended or adjusted under 35 U.S.C. 154(b) by 36 days.

(21) Appl. No.: 11/867,181

(22) Filed: Oct. 4, 2007

(65) Prior Publication Data

US 2009/0090830 A1 Apr. 9, 2009

(51) Int. Cl.
*A47K 1/00* (2006.01)

(52) U.S. Cl. ..... 248/215; 248/126; 248/127; 248/156; 248/166

(58) Field of Classification Search ..... 248/177.1, 248/176.1, 316.1, 316.5, 316.8, 231.41, 121, 248/122.1, 126, 274.1, 276.1, 278.1, 309.1, 248/519, 534, 540
See application file for complete search history.

(56) References Cited

U.S. PATENT DOCUMENTS

| | | | | |
|---|---|---|---|---|
| D260,674 | S | 9/1981 | Simmons et al. | |
| 4,331,311 | A * | 5/1982 | Russell | 248/176.1 |
| 4,360,179 | A * | 11/1982 | Roberts | 248/126 |
| 4,377,270 | A * | 3/1983 | Kolongowski | 248/441.1 |
| 4,542,873 | A | 9/1985 | Matherly et al. | |
| D281,344 | S | 11/1985 | Duke | |
| D299,199 | S | 1/1989 | Rogowski | |
| 4,896,854 | A | 1/1990 | St. Laurent | |
| 4,936,415 | A | 6/1990 | Williams | |
| 4,957,229 | A | 9/1990 | Freeman | |
| D314,303 | S | 2/1991 | Glaspie | |
| D316,780 | S | 5/1991 | Chilcutt et al. | |
| 5,048,504 | A * | 9/1991 | Ballard | 124/86 |
| 5,111,800 | A | 5/1992 | Reynolds | |
| 5,249,722 | A | 10/1993 | Horn | |
| 5,310,150 | A | 5/1994 | Fecko | |
| 5,377,657 | A | 1/1995 | Foster et al. | |
| 5,465,933 | A | 11/1995 | Todd | |
| D371,416 | S | 7/1996 | Bliss | |
| D375,645 | S | 11/1996 | Foster et al. | |
| D386,304 | S | 11/1997 | Hancock | |
| 5,711,467 | A | 1/1998 | Brown, Sr. | |
| 5,713,112 | A * | 2/1998 | Genero et al. | 24/490 |
| 5,775,658 | A | 7/1998 | Englehardt | |
| 5,806,508 | A | 9/1998 | Stempien et al. | |
| 5,850,955 | A | 12/1998 | Barr | |
| D422,333 | S | 4/2000 | Foster et al. | |
| 6,086,026 | A * | 7/2000 | Pearce | 248/127 |
| 6,244,556 | B1 * | 6/2001 | Carrillo et al. | 248/519 |

(Continued)

*Primary Examiner*—J. Allen Shriver, II
*Assistant Examiner*—Alaeddin Mohseni
(74) *Attorney, Agent, or Firm*—McKee, Voorhees & Sease, P.L.C.

(57) ABSTRACT

A device and method for securing a bow while hunting is provided. The device generally includes a base, a support arm rotatably mounted to the base, a connecting arm connected to the support arm, and a retaining arm rotatably connected to the connecting arm and mounted for rotation between an open position and a closed position to secure the limb of the bow. The support arm acts as a lever arm wherein the weight of the bow causes the connecting arm to move and the retaining arm to rotate from an open position to a closed position to secure the limb of the bow.

22 Claims, 6 Drawing Sheets

U.S. PATENT DOCUMENTS 6,267,278 B1 7/2001 Bogart
6,457,685 B1 * 10/2002 Taylor ..... 248/166
6,663,059 B1 12/2003 Warren
6,726,160 B1 * 4/2004 Buchanan, Jr. ..... 248/156
6,726,162 B1 4/2004 Winter
6,749,170 B1 * 6/2004 Rhoads ..... 248/545
7,163,183 B2 1/2007 Sutherland et al.
2005/0035249 A1 * 2/2005 Busuito ..... 248/215

* cited by examiner

DEVICE AND METHOD FOR SECURING A BOW

BACKGROUND OF THE INVENTION

The present invention relates to hunting accessories, and, in particular, a device and method for securing a bow while hunting.

Bow hunting is not considered an easy task. Using a bow to hunt animals such as deer, elk, bear and turkey offers a great challenge to hunters. Success requires more than just good archery skills. Hunting with a bow instead of a gun requires the hunter to get much closer to the animal. While some hunters prefer to move in toward their target, many find it easier to set up and wait for the animal to make an entrance. For example, bow hunters often set up in tree stands or ground blinds near trails where the animals have been known to move. During periods of long wait while hunting, many bow hunters prefer to use a bow holder of some type, which frees up the hunter's hands for other tasks, such as making animal game calls.

One method of securing a bow while hunting is to use a hook or hanger, which is usually screwed into the side of a tree or the wall of a permanent hunting blind. The bow hangs from the hook or hanger when not in use. Of course, this method does not work when hunting from a ground blind. Furthermore, the bow tends to knock against the tree or other supporting structure creating unwanted noise.

Other bow holders have been used in tree stands. The two most common styles of bow holders are shown in FIGS. 1 and 2. The bow holder 10 shown in FIG. 1 is a plate with a slot or cut away section between two forks in the plate. The hunter slides the limb 12 of the bow 14 into the slot between the two forks of the bow holder 10. The limb 12 is then tilted back, which places torque on the limb 12. To remove the bow 14 from the bow holder 10, the hunter tilts the limb 12 forward and then moves the limb 12 laterally out of the slot of the bow holder 10. As such, two separate movements are required to either set the bow 14 in the bow holder 10 or release the bow from the holder. It is also possible for the bow to become dislodged from the bow holder when the bow is accidentally hit or struck from the side.

The other common style for a bow holder is shown in FIG. 2. Here, the hunter must angle the end of the bow limb 12 into the cradle-type bow holder 16 and then tilt the bow backwards. Again, movement in two different directions is required to set or release the bow from the holder. Also, the bow could easily become dislodged from the cradle-type bow holder 16.

There is therefore a need in the art for a bow holder that works well from either a tree stand, permanent blind, or ground blind.

There is also a need in the art for a bow holder that is easy to use and requires a minimum amount of movements by the hunter.

There is also a need in the art for a bow holder that secures the bow to the holder even when the bow is accidentally hit or struck while in the holder.

BRIEF SUMMARY OF THE INVENTION

It is therefore a primary object, aspect, feature or advantage of the present invention to provide a device and method for securing a bow which improves over or solves the problems and deficiencies in the art.

Another object, feature, aspect and/or advantage of the present invention relates to an apparatus for securing a bow that is easy to use and allows the user to set and release the bow from the holder in a fluid motion to eliminate unnecessary movement while hunting.

Yet another object, feature, aspect and/or advantage of the present invention relates to a bow holder that prevents the bow from becoming dislodged from the holder.

A still further object, feature, aspect and/or advantage of the present invention is a method of setting and releasing a bow from a bow holder that eliminates unnecessary movement.

These and other objects, features, aspects and/or advantages of the present invention will become apparent with reference to the accompanying specification and claims.

One aspect of the invention includes a base, a support arm pivotally mounted to the base with a limb support adapted to support a limb of the bow, a connecting arm connected to the support arm opposite the limb support, and a retaining arm pivotally connected to the connecting arm and mounted for rotation between an open position and a closed position to secure the limb of the bow. The support arm acts as a lever arm such that a force applied to the limb support on the support arm by the weight of the bow causes the retaining arm to pivot and rotate to the closed position around the limb of the bow. In a preferred form, the apparatus or bow holder also includes a second connecting arm and second retaining arm, wherein the connecting arms and the retaining arms oppose one another and more securely hold the bow in the closed position.

Another aspect of the invention includes a method of temporarily securing a bow during hunting. The method includes using a bow holder having a base, a support arm having a first end and a second end and being pivotally mounted to the base about a first pivot point between the first and second ends, the support arm having a limb support on one side of the first pivot point adapted to support a limb with the bow and a limb rest on a side of the pivot point opposite the limb support, a connecting arm connected to the support arm on the side of the first pivot point opposite the limb support, and a retaining arm pivotally connected to the connecting arm and pivotally mounted about a second pivot point. The hunter positions a limb of the bow on the limb rest and lowers the limb of the bow onto the limb support. This can be accomplished in a single fluid motion. When the limb is lowered onto the limb support, the weight of the bow applies a force to the limb support that causes the retaining arm to pivot and rotate at least partially around the limb of the bow near the limb rest.

DETAILED DESCRIPTION OF THE EXEMPLARY EMBODIMENTS

Figure 1:
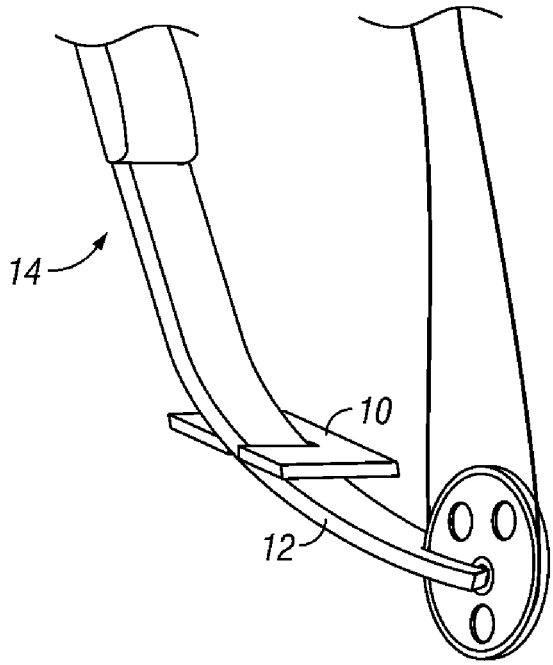
FIG. 1 (Prior Art)
FIG. 1 is a perspective view of a prior art bow holder with a bow mounted in the bow holder.
Figure 2:
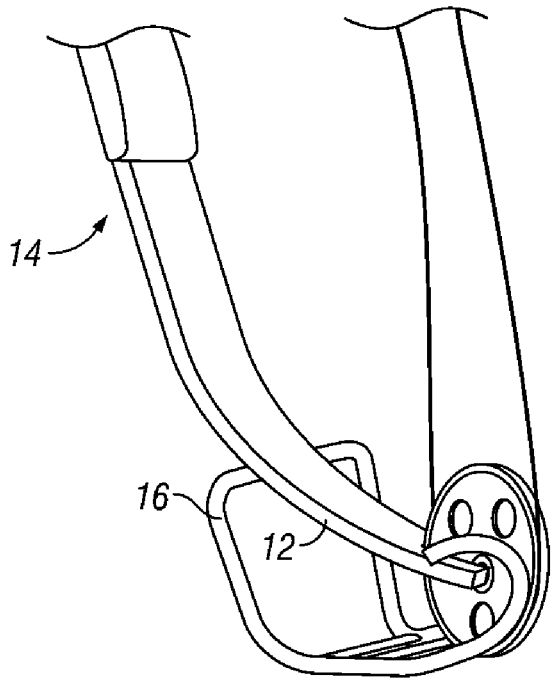
FIG. 2 (Prior Art)
FIG. 2 is a perspective view of another prior art bow holder with a bow mounted in the bow holder.

For a better understanding of the invention, examples and forms of the invention will now be described in detail. Frequent reference will be made to the accompanying figures. Reference numerals will be used to indicate certain parts or locations in the figures. The same reference numerals will be used to indicate the same or similar parts or locations throughout the figures unless otherwise indicated.

Figure 3:
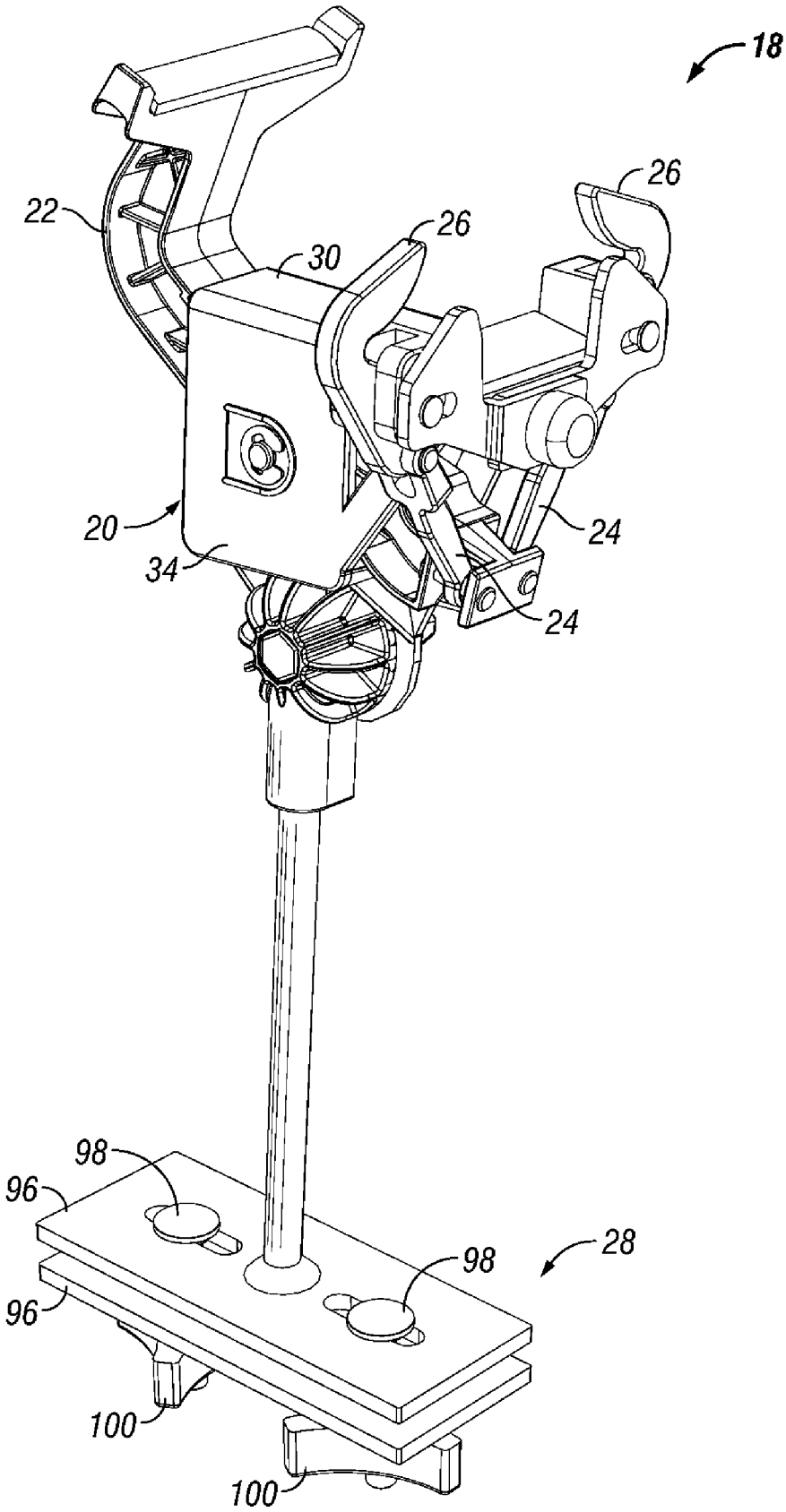
FIG. 3 is a perspective view of a preferred embodiment of the bow holder of the present invention.
Figure 4:
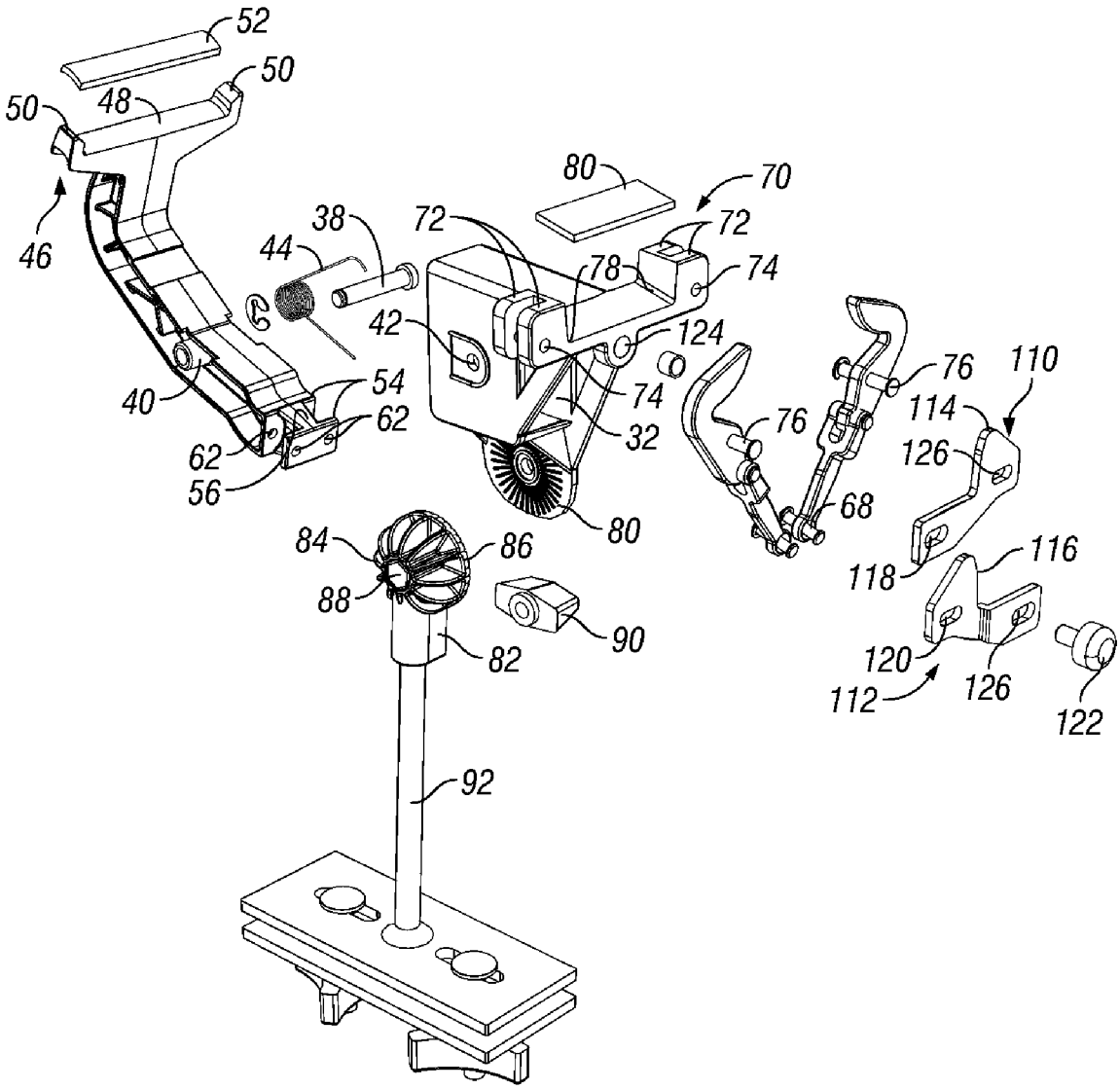
FIG. 4 is an exploded perspective view of the bow holder shown in FIG. 3.

Referring to FIG. 3, a preferred form of the bow holder of the present invention is generally designated by the reference numeral 18. The principal components of the bow holder 18 include a base 20, a support arm 22, connecting arms 24, retaining arms 26, and a floor support 28. FIG. 4 is an exploded view that shows the various parts of the bow holder 18.

The base 20 includes a top wall 30, a bottom wall 32 and two opposing side walls 34, 36, which define a hollow interior space. The support arm 22 extends through the interior of the base 20 and is rotatably mounted to the base 20 by passing a pin 38 through a cylindrical channel 40 on the support arm 22 aligned with apertures 42 on the opposing side walls 34, 36 of the base 20. The support arm 22 acts as a lever arm by rotating about a pivot point defined by the pin 38. A torsion spring 44 is positioned around the end of the pin 38 adjacent the opening to the cylindrical channel 40 between the cylindrical channel 40 and the side wall 34 of the base 20. The torsion spring 44 stores rotational energy and applies a torque to the support arm 22 so that it is yieldedly biased in a forward direction to provide resistance against the bow 14 when it set in the bow holder 18.

The support arm 22 is arcuate shaped. At one end of the support arm 22 is a limb support 46. The limb support 46 includes a support surface 48 between two upwardly projecting retaining fingers 50 on opposite sides of the support surface 48. A rubber pad 52 is preferably disposed on the support surface 48 to cushion the limb 12 of the bow 14 to guard against scratching or marring the surface of the limb 12. The rubber pad 52 also reduces noise and helps prevent the limb 12 of the bow 14 from sliding when in contact with the limb support 46.

On an end of the support arm 22 opposite the limb support 46 are two parallel mounting plates 54 connected by an interconnecting web 56. The connecting arms 24 are pivotally mounted to the support arm 22 with pins 60 that extend through apertures 62 on the mounting plates 54.

The connecting arms 24 have a U-shaped portion 64 at one end used to rotatably connect the connecting arms 24 to the retaining arms 26. Pins 68 are inserted through the U-shaped portion 64 of the connecting arms 24 at one end of the retaining arms 26.

The base 20 of the bow holder 18 includes a generally U-shaped mounting structure 70. At opposite ends of the mounting structure 70 are opposing mounting plates 72 with aligned apertures 74 for receiving pins 76 to rotatably mount the retaining arms 26 between the mounting plates 72 of the base 20.

The mounting structure 70 also acts as a rest for the limb 12 of the bow 14. A support surface 78 extends between the mounting plates 72. Again, it is preferred that a rubber pad 80 be disposed on the support surface 78.

Figure 5:
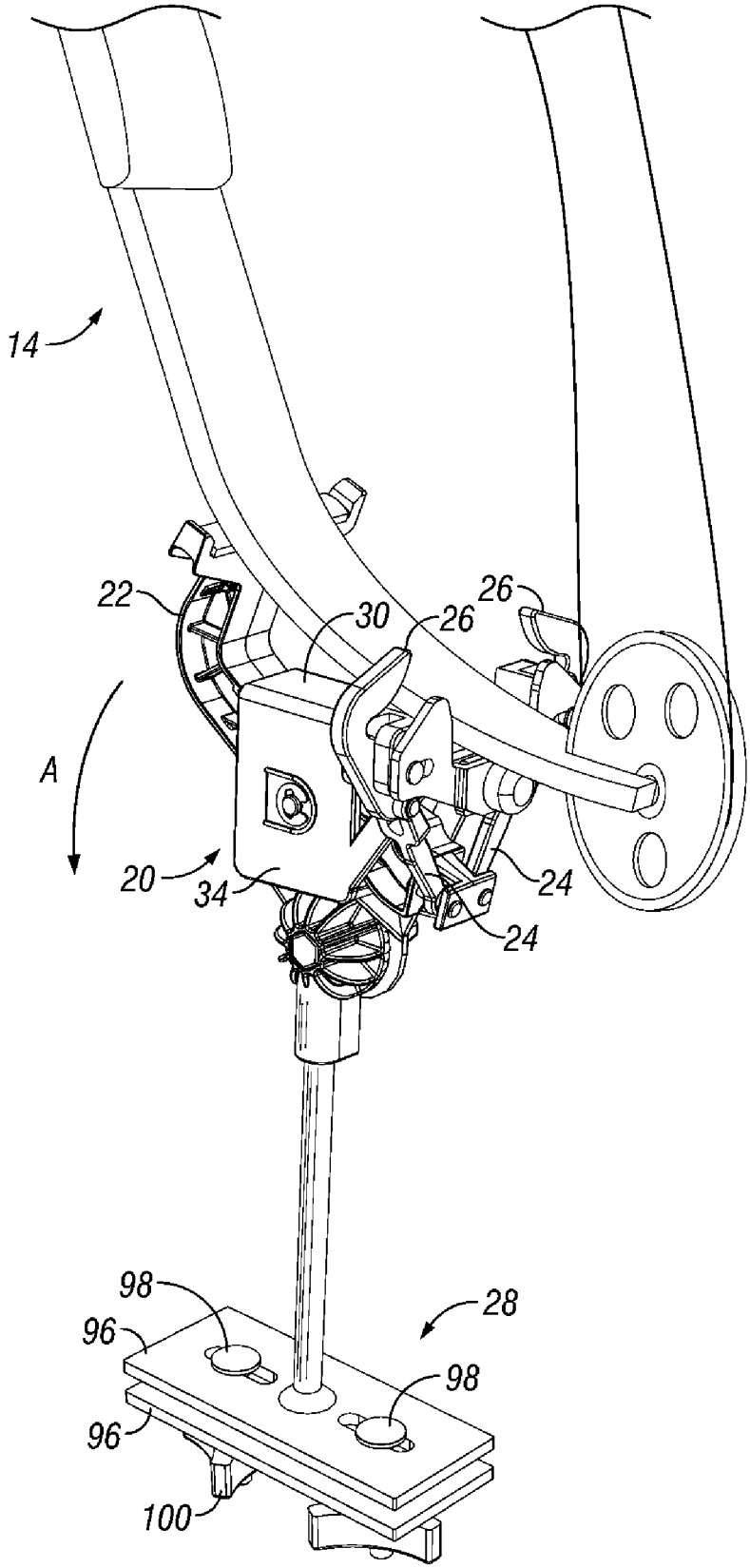
FIG. 5 is a perspective view of the preferred bow holder of the present invention in an open position and a bow positioned for setting in the holder.
Figure 6:
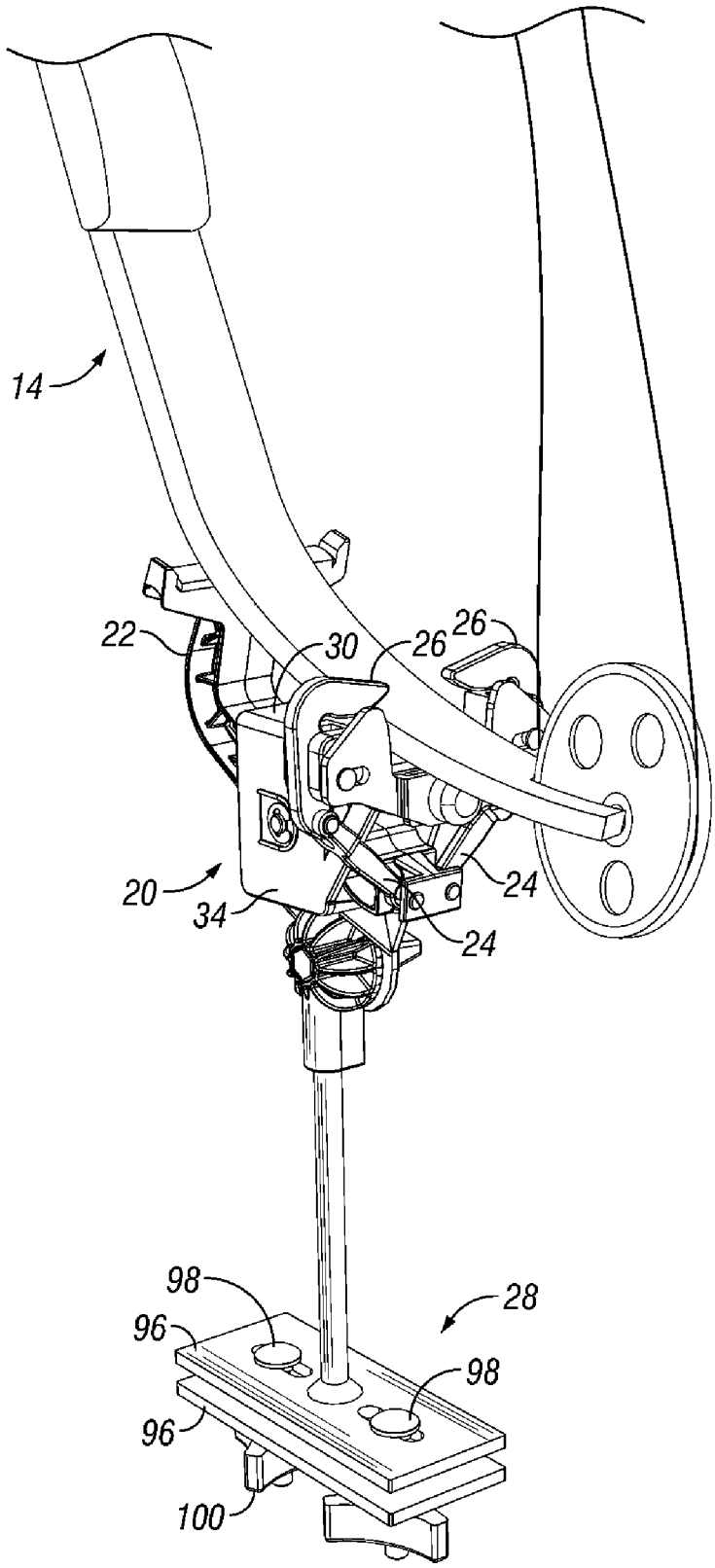
FIG. 6 is a perspective view similar to FIG. 5, showing the bow holder in a closed position to secure the bow.

The purpose of the retaining arms 26 is to hold the lower end of the limb 12 of the bow 14 in position while the bow 14 is set in the bow holder 18. FIG. 5 shows the bow holder 18 with the retaining arms 26 in an open position. When a sufficient force is applied to the limb support 46 by the weight of the bow 14 to overcome the rotational energy stored in the torsion spring 44, the support arm 22 rotates in a direction A (see FIG. 5), which in turn causes the connecting arms 24 to rotate outwardly and the retaining arms 26 to rotate inwardly at least partially around the limb 12 of the bow 14 (see FIG. 6). It is preferred that the retaining arms 26 rotate sufficiently to contact the limb 14. The retaining arms 26 are generally C-shaped and can have a resilient pad or coating on the tips to reduce unwanted noise and prevent marring and scratching of the limb 12 when the retaining arms 26 come into contact with the limb 12.

On one side of the base 20 extends a circular mounting surface 80 having a plurality of teeth extending radially outward from the center of the mounting surface 80. A mounting block 82 includes a plurality of fins 84 on one side and a plurality of teeth on the opposite side 86 that fit in a mating relationship with the teeth on the support surface 80 of the base 20.

Figure 7:
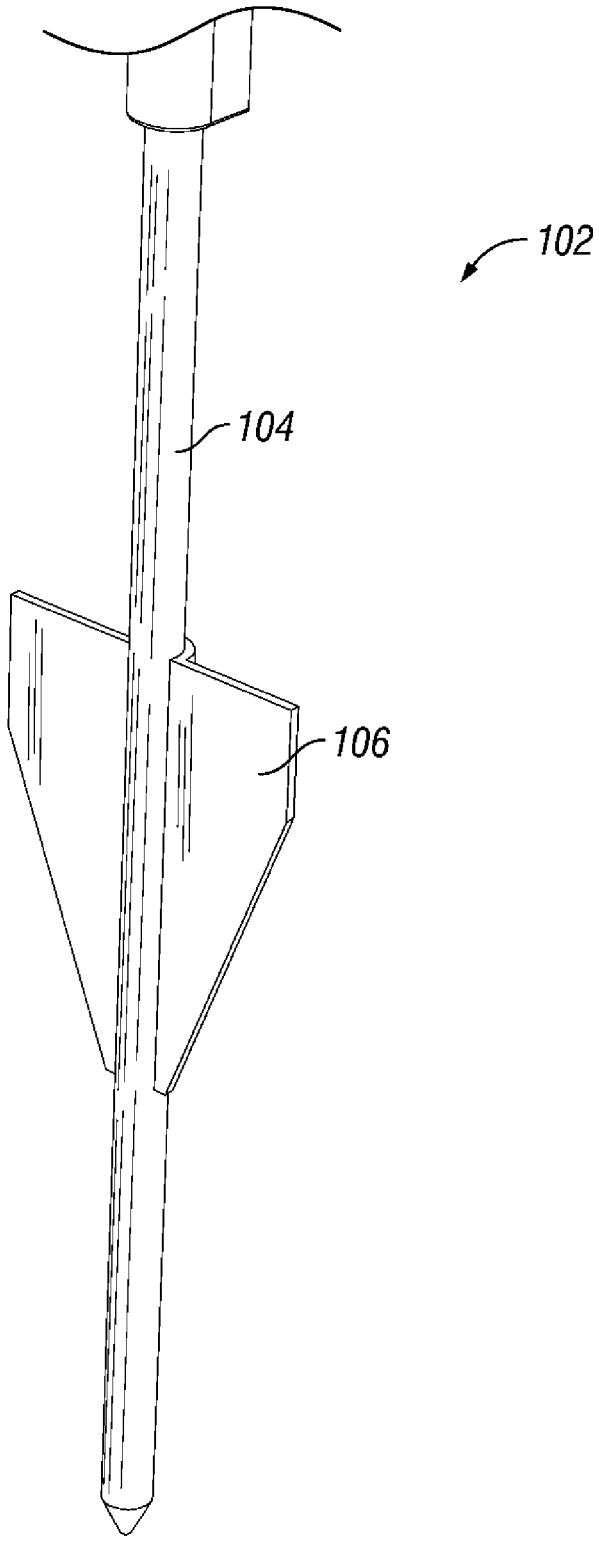
FIG. 7 is a perspective view of a ground support for use with the present invention.

A screw knob 84 on screw 90 can be adjusted to loosen the mounting block 82 from the base 20 and pivot or rotate the base 20 relative to the mounting block 82. A support rod 92 extends downwardly from the mounting block 90. The support rod 92 terminates at one end at a floor support 28 that comprises parallel plates 96 held together with screws 98 and knobs 100 threaded on the screws 98. The plates 96 can be clamped around the floor of a tree stand or permanent blind (not shown) to secure the bow holder 18 in a fixed position. Alternatively, a ground stake 102, as shown in FIG. 7, can be used in place of the floor support 94 when hunting from a ground blind and the hunter desires to stabilize or secure the bow holder 18 in the ground. The ground support 102 includes a ground stake and plate 106 with tapered sides extending radially therefrom.

The bow holder 18 preferably includes a limb guide 108 comprised of a first plate 110 and a second plate 112. The first plate 110 is generally planar and includes a retaining portion 114 at one end. The second retaining plate 112 includes a similar retaining portion 116 that is offset by approximately the width of the plate 110 such that when the guide plates 110 and 112 overlap one another, the retaining portions 114 and 116 are aligned. The first and second guide plates 110, 112 include slots 118, 120, through which a screw 122 is inserted and received into a threaded aperture 124 in the base 20. The first and second guide plates 110, 112 also include slots 126 for receiving pin 68 extending between the mounting plates 72 of the mounting structure 70. The purpose of the limb guide 108 is to assist the hunter in properly positioning the limb 12 of the bow 14 on the support surface 78 and prevent the limb 12 from moving laterally. The screw 122 can be loosened to slideably adjust the guide plates 110, 112 relative to one another, thus accommodating bows having limbs of various widths.

To set the bow 14 in the bow holder 18, the hunter positions the lower end of the limb 12 of the bow 14 on the support surface 78 between the retaining portions 114, 116 of the limb guide 108. The user then lowers the bow 14 such that the limb 12 contacts the limb support 46 between the retaining fingers 50. As the weight of the bow 14 applies a force to the limb support 46, the support arm 22 rotates, causing the retaining arms 26 to rotate down onto the lower end of the limb 12. The bow 14 is therefore held firmly in place by its own weight.

To release the bow 14 from the bow holder 18, the user simply takes weight off the limb support 46 by raising the bow 14, which in turn rotates the retaining arms 26 to an open position such that the lower portion of the limb 12 is free to move away from the bow holder 18. One skilled in the art can appreciate that this exemplary embodiment of the present invention allows the hunter to set and release the bow 14 in the bow holder 18 using a single fluid motion. The bow 14 is also secured in place when the retaining arms 26 are in the closed position, avoiding the possibility that the bow 14 will become dislodged from the bow holder 18 upon inadvertent contact with the bow 14.

The principal or primary components of the bow 14 are preferably made of a high impact plastic. Other materials may also be used.

This detailed description is of exemplary embodiments and various modifications and variations are contemplated. For example, a single connecting arm and retaining arm could be used, but a pair of each is preferred. The invention is only to be limited by the claims, which are appended hereto.

What is claimed is:

1. An apparatus for securing a bow comprising:

a base;

a support arm having a first end and a second end and being rotatably mounted to the base about a first pivot point between the first and second ends, the support arm having a limb support on one side of the pivot point adapted to support a limb of the bow;

a connecting arm connected to the support arm on a side of the first pivot point opposite the limb support; and a retaining arm rotatably connected to the connecting arm and rotatably mounted about a second pivot point for rotation between an open position and a closed position to secure the limb of the bow;

whereby a force applied to the limb support causes the retaining arm to rotate about the second pivot point to the closed position at least partially around the limb of the bow.

2. The apparatus of claim 1 wherein the connecting arm is rotatably connected to the support arm.

3. The apparatus of claim 1 wherein the connecting arm includes a first end rotatably connected to the support arm and a second end rotatably connected to the retaining arm so that the force applied to the limb support causes the second end of the connecting arm to rotate outwardly and the retaining arm to rotate inwardly at least partially around the limb of the bow.

4. The apparatus of claim 1 wherein the retaining arm is rotatably mounted on the base about the second pivot point.

5. The apparatus of claim 1 wherein the retaining arm rotates at least partially around the bow to secure the bow between the retaining arm and a bow rest on the base.

6. The apparatus of claim 1 wherein the base is mounted to a floor support.

7. The apparatus of claim 6 wherein the base is rotatably mounted to a floor support.

8. The apparatus of claim 7 wherein the floor support includes a clamping mechanism.

9. The apparatus of claim 1 wherein the base is mounted to a ground support.

10. The apparatus of claim 9 wherein the base is rotatably mounted to a ground support.

11. The apparatus of claim 10 wherein the ground support includes a stake with a plate connected to the stake that is adapted to be inserted into the ground.

12. The apparatus of claim 1 further comprising:

a second connecting arm connected to the support arm on the side of the first pivot point opposite the limb support; and a second retaining arm rotatably connected to the second connecting arm and rotatably mounted about a third pivot point for rotation between an open position and a closed position to secure the limb of the bow;

whereby a force applied to the limb support causes the retaining arm and the second retaining arm to rotate to the closed positions at least partially around the limb of the bow.

13. The apparatus of claim 1 further comprising a limb guide adjustably mounted on the base to accommodate limbs of various widths.

14. The apparatus of claim 1 wherein the support arm includes a limb rest on a side of the pivot point opposite the limb support and the apparatus further comprises a limb guide adjustably mounted on the base adjacent the limb rest to accommodate limbs of various widths.

15. The apparatus of claim 14 wherein the limb guide includes a plate with a retaining portion.

16. The apparatus of claim 14 wherein the limb guide includes at least two plates each having a retaining portion, the plates being slidably and adjustably mounted to the base to accommodate limbs of various widths between the retaining portions of the plates.

17. An apparatus for securing a bow comprising:

a base;

a support arm having a first end and a second end and being rotatably mounted to the base about a first pivot point between the first and second ends, the support arm having a limb support on one side of the pivot point adapted to support a limb of the bow and a limb rest on a side of the first pivot point opposite the limb support;

a pair of connecting arms connected to the support arm on a side of the first pivot point opposite the limb support; and a pair of retaining arm rotatably each connected to one of the connecting arms and rotatably mounted to the base;

whereby a force applied to the limb support causes the retaining arms to rotate about the limb rest and at least partially close around the limb of the bow disposed between the retaining arms and the limb rest.

18. The apparatus of claim 17 further comprising a limb guide adjustably mounted on the base near the limb rest to accommodate limbs of various widths.

19. The apparatus of claim 18 wherein the limb guide includes at least two plates each having a retaining portion, the plates being slidably and adjustably mounted to the base to accommodate limbs of various widths between the retaining portions of the plates.

20. The apparatus of claim 17 wherein the base is rotatably mounted to a floor support.

21. The apparatus of claim 17 wherein the base is rotatably mounted to a ground support.

22. The apparatus of claim 17 wherein the connecting arms are rotatably connected to the support arm.

* * * * *